US005447447A

United States Patent [19]

Guss, III et al.

[11] Patent Number: 5,447,447

[45] Date of Patent: Sep. 5, 1995

[54] VIBRATION RESISTANT ELECTRICAL COUPLING WITH TACTILE INDICATION

[75] Inventors: Robert J. Guss, III, Glen Ellyn, Ill.; David A. Wandler, Burlington, Wis.; Simeon T. Lee, Barrington, Ill.

[73] Assignee: Woodhead Industries, Inc., Buffalo Grove, Ill.

[21] Appl. No.: 261,449

[22] Filed: Jun. 17, 1994

Related U.S. Application Data

[62] Division of Ser. No. 974,089, Nov. 10, 1992, Pat. No. 5,322,451.

[51] Int. Cl.[6] ..... H01R 13/623

[52] U.S. Cl. ..... 439/321

[58] Field of Search ..... 439/312–323; 285/81, 82, 85, 88

[56] References Cited

U.S. PATENT DOCUMENTS

| | | | |
|---|---|---|---|
| 3,917,373 | 11/1975 | Peterson | 439/321 |
| 4,154,496 | 5/1979 | Gallagher . | |
| 4,257,663 | 3/1981 | Brush et al. . | |
| 4,268,103 | 5/1981 | Schildkraut . | |
| 4,291,933 | 9/1981 | Kakaris . | |
| 4,304,456 | 12/1981 | Takaki et al. . | |
| 4,359,254 | 11/1982 | Gallusser et al. | 439/321 |
| 4,407,529 | 10/1983 | Holman | 285/82 |
| 4,462,653 | 7/1984 | Flederbach et al. | 439/321 |
| 4,603,934 | 8/1986 | Burns | 439/321 |
| 4,703,988 | 11/1987 | Raux et al. | 439/321 |
| 4,793,821 | 12/1988 | Fowler et al. | 439/321 |
| 4,808,123 | 2/1989 | Dee et al. | 439/321 |
| 4,820,184 | 4/1989 | Brandes | 439/321 |
| 4,834,667 | 5/1989 | Fowler et al. | 439/321 |
| 4,838,805 | 6/1989 | Sturges | 439/321 |
| 4,900,260 | 2/1990 | Drogo | 439/321 |
| 4,984,995 | 1/1991 | Tucker et al. | 439/321 |

*Primary Examiner*—Neil Abrams
*Attorney, Agent, or Firm*—Emrich & Dithmar

[57] ABSTRACT

An electrical connector (10) adapted for connection to a complementary connector includes an insert (16) having a plurality of connecting elements disposed within a cylindrical molded body (14) from which a multi-conductor cord (12) extends. A coupling nut (22) is disposed about the insert (16) and has inner threads (**22*a*) for engaging and drawing the complementary connector into secure engagement with a first surface (26*a*) of an annular flange (26) disposed about the periphery of the insert. In one embodiment, the coupling nut (22) includes an annular, inner flange (34) having a plurality of spaced, symmetrical detents (36) forming teeth. A washer (24) includes asymmetrical projections or teeth on one surface which engage the annular flange of the insert when coupling nut (22) is tightened. The washer (24) further includes second symmetrical projections (50) on a second, opposed surface to form a driving engagement with corresponding teeth on the coupling nut. An outer sheath (60) may be assembled to the coupling nut (22**) to permit the coupling nut to be rotated for tightening until a predetermined torque is reached, whereupon the sheath freely rotates about the tightened coupling nut.

11 Claims, 3 Drawing Sheets

FIG.17
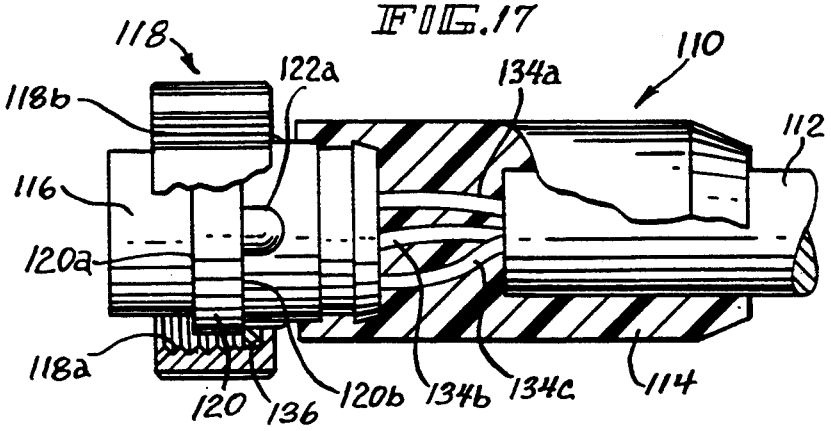
FIG.19
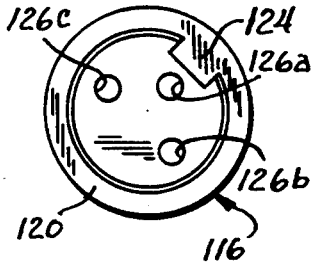
FIG.18
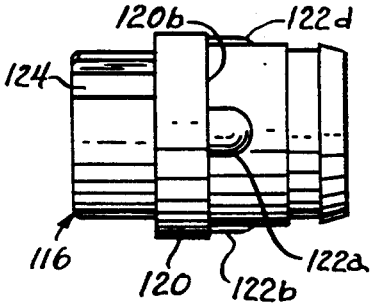
FIG.20
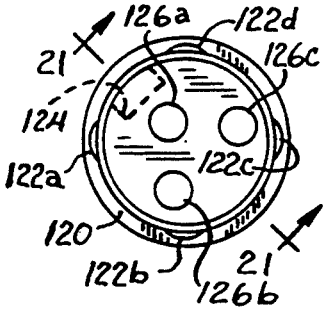
FIG.21
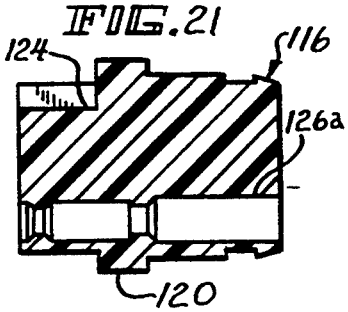
FIG.26
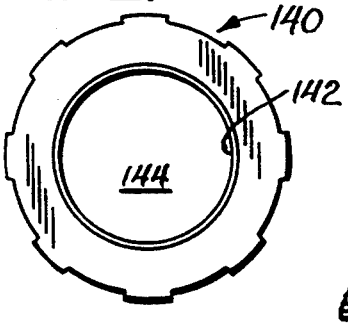
FIG.25
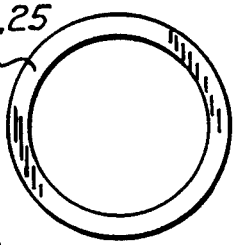
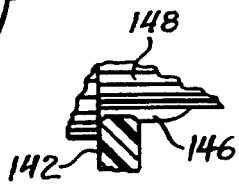
FIG.27
FIG.22
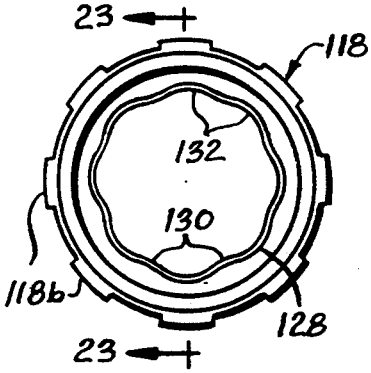
FIG.23
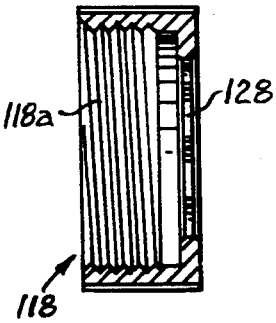
FIG.24
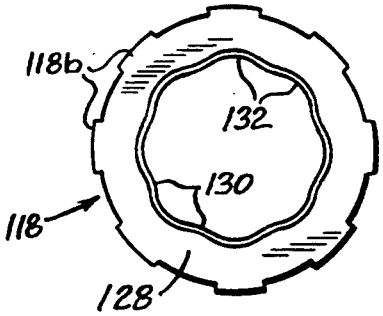

VIBRATION RESISTANT ELECTRICAL COUPLING WITH TACTILE INDICATION

RELATED APPLICATIONS

This is a divisional application of co-pending co-owned U.S. application Ser. No. 07/974,089, filed Nov. 10, 1992 for VIBRATION RESISTANT ELECTRICAL COUPLING WITH TACTILE INDICATION, now U.S. Pat. No. 5,322,451, issued Jun. 21, 1994.

BACKGROUND OF THE INVENTION

This invention relates generally to multi-wire electrical connectors and is more particularly directed to vibration resistant, threaded electrical coupling assemblies which provide a tactile indication of connector tightening and locking.

BACKGROUND OF THE INVENTION

The great versatility of programmable logic controllers permits the programmable logic controller to monitor and control virtually any type of operating system. In the past, programmable logic controllers were frequently hard-wired to various sensors and devices within the system for monitoring and controlling their operation. Hard-wired installations limit the flexibility and adaptability of the programmable logic controller by preventing connection of the programmable logic controller to another component in the operating system or to another operating system. Multi-wire electrical connectors are increasingly being used for connecting the programmable logic controller to the operating system or a component therein to provide this flexibility. Because the electrical leads carry power, sensor and control signals and because the operating environments of such systems are frequently hostile and subject to shock, vibration, and other stresses, electrical connectors used in such applications must be rugged, easily installed and removed, and must accommodate a plurality of discrete conductors.

These types of connectors frequently include a threaded coupling nut attached to a molded connector body with conductive pins or inner contacts which is adapted for coupling to a mating connector assembly. The threaded coupling nut is subject to loosening due to shock and vibration such as encountered in many common manufacturing environments. Once the threaded coupling nut becomes unseated, removal of the plug-like leads from the socket portion of the connector is easily accomplished, resulting in a breaking of the electrical connection. In addition, it is difficult to determine the extent to which the coupling nut is secured. If it is turned too much, deformation or damage may result. If the nut is not fastened enough, the tendency to become loose is greater.

The present invention addresses the aforementioned limitations of the prior art by providing a high strength, locking, vibration resistant electrical coupling which also affords a user a tactile indication of tightening and locking of the connector portions.

SUMMARY OF THE INVENTION

The present invention includes first and second mating connector portions secured together by a coupling nut. One connector portion has a molded body coupled to an electrical cord and an elastomeric insert adapted for electrical coupling to the mating connector and integral with the molded body. The insert includes a peripheral flange having first and second opposed surfaces. The coupling nut is disposed about the insert and has internal threads for coupling to the mating connector. In one embodiment, the coupling nut includes a plurality of spaced, beveled detents disposed about an inner periphery so that when the coupling nut is rotated in a first direction the mating connector is drawn toward and engages the insert until the mating connector engages the adjacent surface of the insert flange. A washer is disposed between the coupling nut and the insert. One toothed surface of the washer is engaged and driven by the coupling nut when the coupling nut is rotated. The other surface of the washer has a second set of teeth which engage a corresponding surface of the insert's flange when the mating connector portions are assembled to lock them together.

Other embodiments of the present invention include a split-washer disposed intermediate an annular, outer flange of the insert and an inner ratchet surface on the coupling nut. A tine portion of the split-washer engages spaced projections about the coupling nut's ratchet flange to provide a tactile indication of coupling nut tightening. Radial unlocking surfaces disposed adjacent each of the spaced projections engage the tine portion of the split-washer when the coupling nut is backed-off, or reverse rotated, for disconnecting the male and female connector components. Yet another embodiment employs cooperating spaced bosses about the periphery of the coupling's insert and an undulating inner flange on the coupling nut. Projections on the undulating flange engage and compress, or distort, the bosses of the elastomeric insert to provide a tactile indication of connector tightening and a locking feature for the connector.

Another feature of the present invention includes an outer sheath disposed about the coupling nut for rotating the coupling nut in a first direction during tightening whereupon the torque applied to the coupling nut is limited by the relative rotational displacement between the sheath and coupling nut when a predetermined torque is reached. The outer sheath securely engages the coupling nut when reverse rotated for loosening the coupling nut and de-coupling the connector components.

BRIEF DESCRIPTION OF THE DRAWINGS

The appended claims set forth those novel features which characterize the invention. However, the invention itself, as well as further objects and advantages thereof, will best be understood by reference to the following detailed description of various embodiments taken in conjunction with the accompanying drawings, where like reference characters identify like elements throughout the various figures, in which:

FIG. 9*a* is an enlarged view of a portion of the outer sheath shown in FIGS. 8 and 9 illustrating details of the sheath's axially aligned coupling ribs;

FIG. 17 is a partially cutaway, lateral sectional view of yet another embodiment of an electrical coupling assembly in accordance with the principles of the present invention;

FIG. 18 is a side elevation view of an elastomeric insert used in the electrical coupling assembly of FIG. 17;

FIG. 19 is a plan view of a first end of the coupling assembly insert shown in FIG. 18;

FIG. 20 is a plan view of a second, opposed end of the coupling assembly insert shown in FIG. 18;

FIG. 21 is a lateral sectional view of the coupling assembly insert shown in FIG. 21 taken along site line 21—21 therein;

FIG. 22 is a plan view of a first end of a coupling nut used in the electrical connector assembly of FIG. 17;

FIG. 23 is a sectional view of the coupling nut shown in FIG. 22 taken along site line 23—23 therein;

FIG. 24 is a plan view of a second, opposed end of the coupling nut used in the electrical coupling assembly of FIG. 17;

FIG. 25 is a plan view of a washer for use in the electrical coupling assembly of FIG. 17;

FIG. 26 is a plan view of another embodiment of a coupling nut for use in the electrical connector assembly of the present invention; and FIG. 27 is an enlarged view of the engagement of an inner flange of the coupling nut of FIG. 26 with an outer tab on the coupling assembly insert shown in FIGS. 18 and 20.

DETAILED DESCRIPTION OF THE VARIOUS EMBODIMENTS

Figure 1:
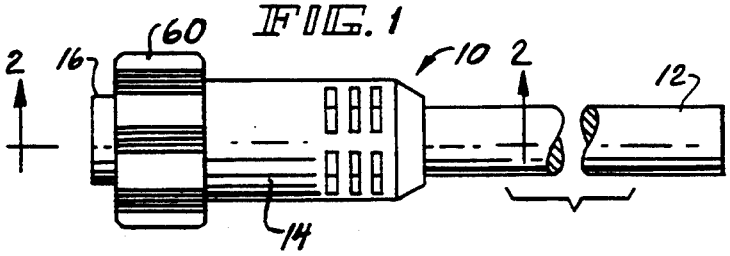
FIG. 1 is a side elevation view of a vibration-resistant electrical coupling assembly in accordance with one embodiment of the present invention.
Figure 2:
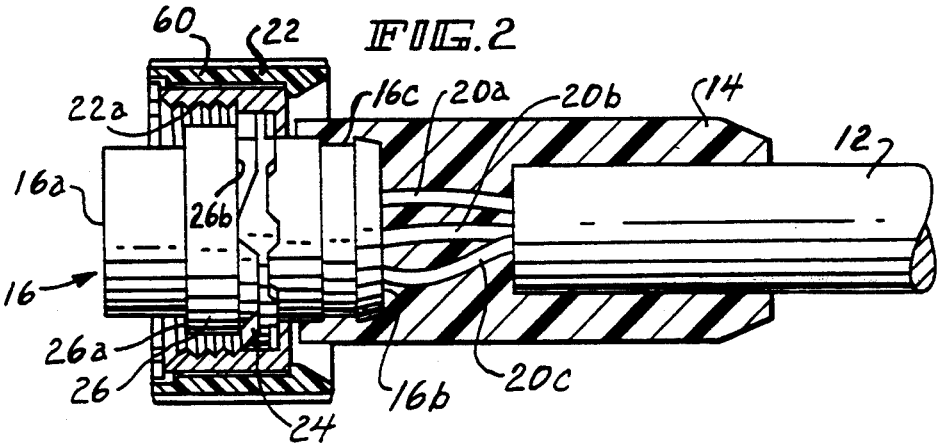
FIG. 2 is a partial cutaway, lateral sectional view of the electrical coupling assembly shown in FIG. 1 taken along site line 2—2 therein.

Referring to FIG. 1, there is shown a side elevation view of a vibration resistant electrical connector assembly 10 in accordance with one embodiment of the present invention. FIG. 2 is a partially cutaway, lateral sectional view of the electrical connector assembly 10 shown in FIG. 1 taken along site line 2—2 therein. The electrical connector assembly 10 includes a one-piece, generally cylindrical molded body 14 from which extends a multi-conductor cord 12. Molded body 14 is made of polyvinyl chloride elastomer or other suitable moldable material. Inserted in one end of the molded body 14 during its formation is an insert 16 comprised of a compressible, resilient elastomeric material. Insert 16 and cord 12 are integrally formed with the molded body 14. Insert 16 includes an outer end 16*a* and an inner end 16*b*. Extending from cord 12 and coupled to socket contacts (not shown in the figure for simplicity) in the inner end 16*b* of insert 16 are a plurality of electrical leads, or wires, 20*a*, 20*b* and 20*c*. The socket contacts, which are described below, extend through insert 16 to its outer end 16*a* and are each adapted for connection to a respective pin on a mating male connector assembly (also not shown in the figure for simplicity). The electrical connector assembly 10 thus forms the female portion of an electrical connector.

Disposed about the periphery of insert 16 is an outer annular flange 26 having first and second opposed surfaces 26*a* and 26*b*. Insert 16 further includes an annular recess 16*c* adjacent the inner end 16*b* thereof for providing secure engagement between the insert and molded body 14 disposed thereabout.

Figure 3:
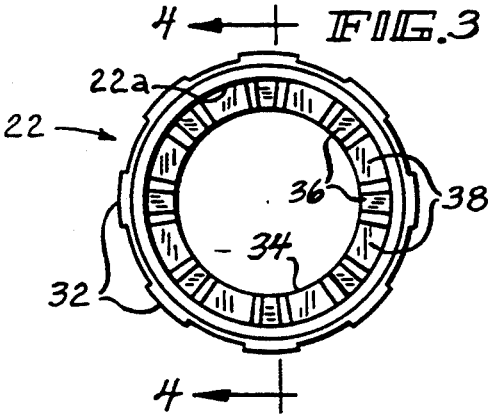
FIG. 3 is an end-on view of a threaded coupling nut used in the electrical coupling assembly of FIG. 1.
Figure 4:
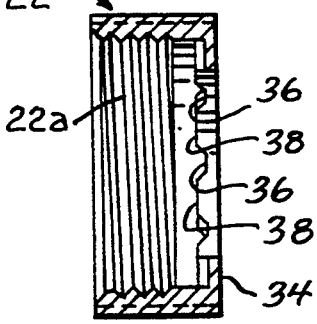
FIG. 4 is a sectional view of the coupling nut shown in FIG. 3 taken along site line 4—4 therein.

Also disposed about insert 16 is a cylindrical coupling nut 22. An end-on plan view of the coupling nut 22 is shown in FIG. 3, while a sectional view of the coupling nut taken along site line 4—4 in FIG. 3 is shown in FIG. 4. Coupling nut 22 includes inner threads 22*a* and an inner annular flange, or shoulder, 34 adjacent one end thereof. Inner threads 22*a* of coupling nut 22 are adapted for coupling to a complementary threaded portion of a mating connector assembly for forming an electrical connection. A plurality of spaced, axial, outer ribs 32 are disposed about the periphery of coupling nut 22. Disposed on an inner surface of the inner peripheral flange 34 are a plurality of symmetrically tapered, or beveled, detents 36. Coupling nut 22 is preferably comprised of a die cast alloy material. With the inner threads 22*a* of coupling nut 22 engaging a mating electrical connector assembly, rotation in a first direction of the coupling nut draws the mating connector assembly toward and into contact with the first surface 26*a* on the outer flange 26 of insert 16. Rotation of coupling nut 22 in a second, opposed direction loosens the connection between the electrical connector assembly 10 and a mating connector assembly for de-coupling the connector components.

Figure 5:
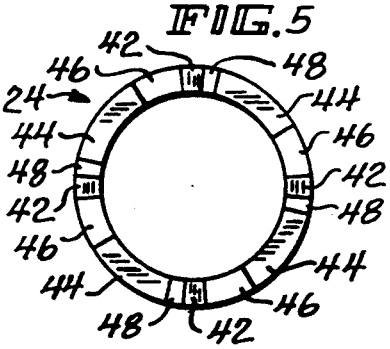
FIG. 5 is a plan view of a first surface of a locking washer used in the electrical coupling assembly of FIG. 1.
Figure 6:
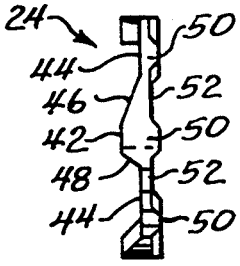
FIG. 6 is a side elevation view of the locking washer shown in FIG. 5.
Figure 7:
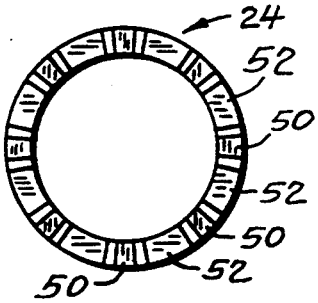
FIG. 7 is a plan view of a second, opposed surface of the locking washer shown in FIG. 5.

Disposed intermediate and engaging the second surface 26*b* of the insert's outer flange 26 and the coupling nut's inner flange 34 is a locking washer 24 preferably comprised of an acetal resin such as Delrin. Plan views of first and second opposed surfaces of locking washer 24 are respectively shown in FIGS. 5 and 7. FIG. 6 is a side elevation view of locking washer 24. Disposed on the first surface of locking washer 24 in a spaced manner are a plurality of first asymmetrical projections 42, with a recess 44 disposed intermediate adjacent projections. Each of the first asymmetrical projections 42 includes a first lead-in ramp 46 and a second back-off ramp 48. As shown in FIG. 6, the second back-off ramp 48 is inclined at a much greater angle relative to the first projection 42 than the first lead-in ramp 46. Each of the first asymmetrical projections 42 is adapted for engagement with the second surface 26*b* of the insert's outer flange 26 when coupling nut 22 is tightened on the mating connector assembly. Disposed in a spaced manner about the second, opposed surface of locking washer 24 are a plurality of symmetrical second projections 50. Disposed intermediate adjacent second projections 50 is a second recess 52. Each of the symmetrical second projections 50 is adapted for insertion in a respective detent 36 on the inner annular flange 34 of coupling nut 22 for securing the electrical connector assembly 10 to a mating connector assembly in a locked manner as described below.

With coupling nut 22 threadably engaging a mating connector assembly, rotation of the coupling nut draws the mating connector assembly into the coupling nut and toward the insert's outer flange 26 until the mating connector assembly engages the first surface 26*a* of the flange. As coupling nut 22 is tightened, each of the second projections 50 on locking washer 24 is disposed within a respective detent 36 on the coupling nut's inner annular flange 34 such that the locking washer rotates with the coupling nut. When coupling nut 22 is fully tightened on the mating connector assembly, the first asymmetrical projections 42 on the locking washer 24 engage the second surface 26*b* of the insert's outer flange 26. With insert 16 preferably comprised of a compressible, resilient elastomeric material, the first asymmetrical projections 42 engage and compress the insert's outer flange 26. As the coupling nut 22 is tightened, the first lead-in ramp 46 of each of the first projections 42 is displaced along and in contact with the second surface 26*b* of the insert's outer flange 26. The reduced slope of the first lead-in ramp 46 facilitates tightening of the coupling nut 22 on the mating connector assembly and ensures secure coupling between electrical connector assembly 10 and its mating connector assembly. On the other hand, the second back-off ramps 48 of each of the first asymmetrical projections 42 have a relatively steep slope which opposes rotation of the coupling nut 22 in a second, opposed direction for breaking the locked coupling between the electrical connector assembly 10 and its mating connector assembly. The asymmetrical configuration of each of the first projections 42 on locking washer 24 thus permits tight-fitting, secure engagement between the electrical connector assembly 10 and its mating connector assembly when coupling nut is rotated in a first direction, while inhibiting de-coupling of these connector assemblies when the coupling nut is rotated in a second, reverse direction. The symmetrical shape of the second projections 50 on locking washer 24 is complementary to that of the tapered detents 36 on the coupling nut's inner annular flange 34 to provide locked engagement between the locking washer and coupling nut 22.

Figure 8A:
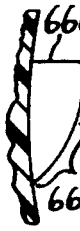
FIG. 8 is an end-on view of an outer sheath disposed about the coupling nut in the electrical coupling assembly of FIG. 1.
Figure 8:
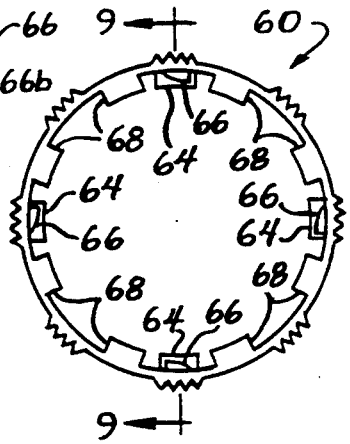
Figure 9:
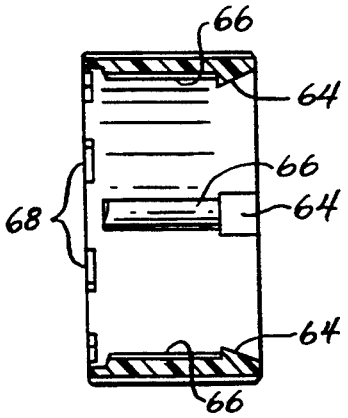
FIG. 9 is a sectional view of the outer sheath shown in FIG. 8 taken along site line 9—9 therein.

Referring to FIG. 8, there is shown an outer sheath 60 adapted for positioning over coupling nut 22 for facilitating rotation of the coupling nut in securely coupling electrical connector assembly 10 to a mating connector assembly. Outer sheath 60 has a generally cylindrical shape and is preferably comprised of a non-conductive, high strength material such as an acetal resin, e.g., Delrin. The generally cylindrical shape of the outer sheath 60 is open at both ends thereof. Disposed about a first end of the outer sheath 60 in a spaced manner are a plurality of inwardly extending retaining tabs 68. Disposed about the periphery of the opposed end of the outer sheath 60 in a spaced manner are a plurality of inwardly directed barbs, or hooks, 64. Each of the barbs 64 is continuous with and extends from an end of a respective elongated, axially aligned coupling rib 66 disposed on an inner surface of the outer sheath. Outer sheath 60 is positioned on coupling nut 22 by inserting the flanged end of the coupling nut into the open end of the outer sheath having the inwardly extending retaining tabs 68. Outer sheath 60 is then displaced downward over the outer surface of the coupling nut 22 until the leading edge of the coupling nut engages the barbs 64 disposed about the periphery of the second end of the sheath. When the coupling nut 22 engages barbs 64, the coupling nut is fully inserted within the outer sheath 60 and the spaced inwardly extending retaining tabs 68 engage the opposed end of the coupling nut to securely maintain the coupling nut in position within the outer sheath. There are preferably four (4) of the aforementioned coupling rib 66 and barb 64 combinations disposed in a spaced manner about the inner periphery of the outer sheath 60. Each of the coupling ribs 66 is adapted to engage a respective outer rib 32 on the coupling nut 22 shown in FIG. 3 as the outer sheath is rotated causing rotational displacement of the coupling nut also. As shown in the enlarged view of FIG. 9*a*, each of the axial coupling ribs 66 includes a curvilinear lead-in ramp 66*a* and a flat back-off surface 66*b*. During tightening, the curvilinear lead-in ramp 66*a* of each of the coupling ribs 66 engages a respective coupling nut outer rib 32. When the coupling nut 22 is fully tightened and upon application of a predetermined torque to the outer sheath 60, the curvilinear lead-in ramps 66*a* slide over the coupling nut's outer ribs 32 limiting the tightening torque applied to the coupling nut. When the outer sheath 60 is rotated in a second, opposed direction, the flat back-off surfaces 66*b* of each of the coupling ribs 66 engage a respective coupling nut outer rib 32 for loosening the coupling nut from the mating connector assembly.

Figure 10:
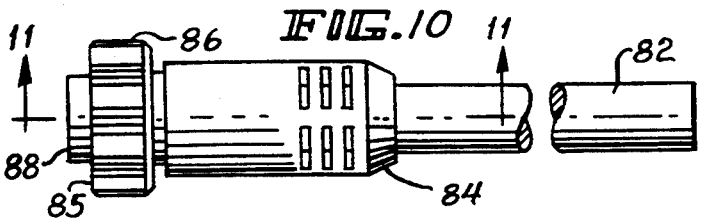
FIG. 10 is a side elevation view of an electrical coupling assembly in accordance with another embodiment of the present invention.
Figure 11:
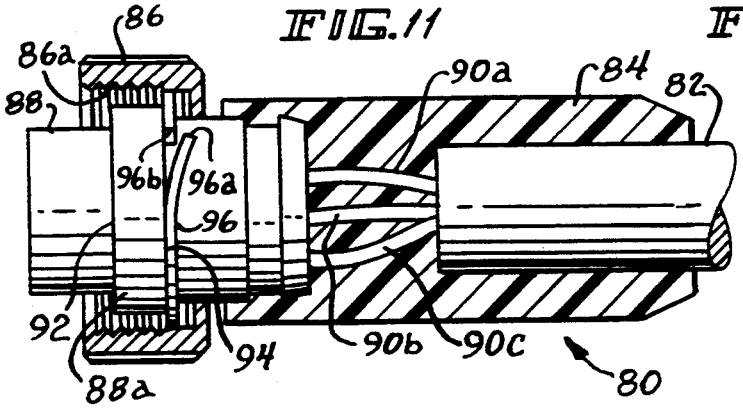
FIG. 11 is a partially cutaway, lateral sectional view of the electrical coupling assembly shown in FIG. 10 taken along site line 11—11 therein.

Referring to FIG. 10, there is shown a side elevation view of another embodiment of an electrical connector assembly 80 in accordance with the principles of the present invention. A partially cutaway, lateral sectional view of the electrical connector assembly 80 shown in FIG. 10 taken along site line 11—11 therein is shown in FIG. 11. As in the previous embodiment, connector assembly 80 includes a molded body 84 from a first end of which extends a multi-conductor cord 82. Attached to and extending from a second end of molded body 84 is an elastomeric insert 88. Insert 88 includes a plurality of socket contacts (not shown in the figures for simplicity) which are each connected at one end of the insert to one of the electrical leads 90*a*, 90*b* and 90*c* extending from cord 82. A second end of insert 88 is adapted for electrical coupling to a mating connector assembly (also not shown in the figure) via a plurality of pins inserted into the aforementioned socket contacts. As many as twelve (12) pins may be accommodated in the electrical coupling of the present invention.

Disposed about insert 88 is a cylindrical coupling nut 86 having inner threads 86*a*. Threads 86*a* are adapted for coupling to the mating connector assembly and for drawing the mating connector assembly toward and into engagement with insert 88. Insert 88 includes an outer annular flange 88*a* having first and second opposed surfaces 92 and 94. When coupling nut 86 is fully tightened onto the mating connector assembly, the mating connector assembly is in abutting contact with the first surface 92 of the insert's outer flange 88a. The coupling nut 86 is preferably comprised of die cast aluminum and is provided with a plurality of spaced axially aligned ribs 85 disposed in a spaced manner about the outer periphery thereof.

Figure 14:
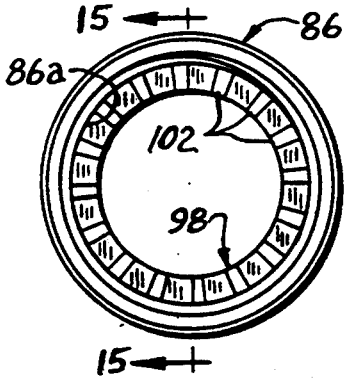
FIG. 14 is an end-on view of a coupling nut used in the electrical coupling assembly of FIG. 11.
Figure 15:
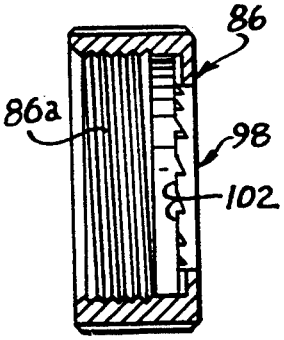
FIG. 15 is a sectional view of the coupling nut shown in FIG. 14 taken along site line 15—15 therein.
Figure 16:
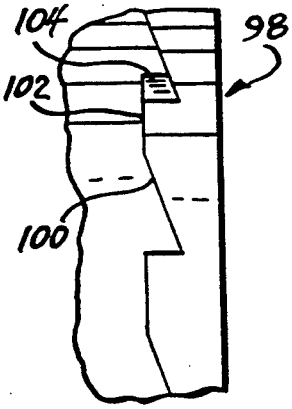
FIG. 16 is an enlarged view of a portion of the ratchet flange in the coupling nut shown in FIGS. 14 and 15.

As shown in FIG. 14 which is an end-on plan view of coupling nut 86, the coupling nut includes an inner annular flange 98. A sectional view of coupling nut 86 taken along site line 15—15 in FIG. 14 is shown in FIG. 15. Annular flange 98 includes a plurality of spaced projections 102 as more clearly shown in the enlarged view of a portion of the flange shown in FIG. 16. Disposed on one side of each projection 102 is a ramp driving surface 100 and on the other side of the projection a radial unlocking surface 104. The combination of a ramp driving surface 100, a projection 102 and a radial unlocking surface 104 is repeated around the entire length of the annular flange 98 to form a ratchet thereon.

Figure 12:
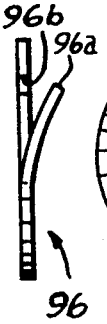
FIG. 12 is a side elevation view of a split ring washer used in the electrical coupling assembly of FIG. 10.
Figure 13:
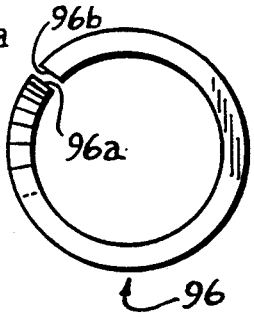
FIG. 13 is a plan view of the split ring washer shown in FIG. 12.

As shown in FIG. 11, disposed intermediate the second surface 94 of the insert's outer annular flange 88*a* and the coupling nut's annular flange 98 is a split-washer 96. The split-washer 96 is shown respectively in a side elevation view and a plan view in FIGS. 12 and 13. Split-washer 96 includes a tine portion 96*a* on a first end and a terminating portion 96*b* on a second end of the washer's base. The tine portion 96*a* is displaced out of the plane of the washer's base which is disposed about insert 88 and in contact with the second surface 94 of the insert's outer annular flange 88*a*.

When coupling nut 86 is rotated in a first direction, the threaded engagement with the mating connector assembly causes the mating connector assembly to move toward the insert's outer flange 88*a* until it engages the flange. In this first direction of rotation, the tine portion 96*a* of split-washer 96 is positioned sequentially in contact with each projection 102 as the coupling nut 86 is rotated. The tine portion 96*a* of split-washer 96 also engages the ramp driving surface 100 of each of the projections 102 as the coupling nut 86 is rotated. This alternating engagement of the split-washer's tine portion 96*a* with a projection 102 and its associated ramp driving surface 100 provides a tactile indication of tightening and locking of the coupling nut 86. The rotation about and linear displacement of coupling nut 86 along the axis of insert 88 causes the coupling nut to force the split-washer 96 into intimate contact with the insert's outer flange 88*a*. Vibration resistance is further provided by the friction fit between the inner diameter of the split-washer 96 and the outer diameter of insert 88.

Rotation of coupling nut 86 in a second, opposed direction causes the split-washer's tine portion 96*a* to engage a radial unlocking surface 104 of one of the spaced projections 102. In order to unlock the electrical connector assembly 80, the frictional engagement between the split-washer 96 and the insert 88 must be overcome by rotating the coupling nut in a second, opposed direction of rotation. This direction of rotation of the coupling nut 86 and split-washer 96 combination is further opposed by engagement of the terminating portion 96*b* of the split-washer with the insert's outer flange 88*a*. However, application of a sufficient torque to the coupling nut 86 will result in displacement of the split-washer and coupling nut combination about insert 88 and a loosening of the electrical connector assembly 80.

Referring to FIG. 17, there is shown a partially cutaway, lateral sectional view of yet another embodiment of an electrical connector assembly 110 in accordance with the present invention. Electrical connector assembly 110 includes a generally cylindrical molded body 114 coupled at one end to a multi-conductor cord 112 and at another, opposed end to a generally cylindrical, elastomeric insert 116. Insert 116 includes a plurality of elongated socket contacts extending the length of the insert such as shown for socket contact 126*a* in the sectional view of FIG. 21 which is taken along site line 21—21 of FIG. 20. Each of the socket contacts disposed in insert 116 is coupled to a respective one of conductors 134*a*, 134*b* and 134*c* disposed within cord 112.

Additional details of insert 116 can be seen from the front and aft end-on plan views of FIGS. 19 and 20 as well as from the side elevation view of FIG. 18. As in the previous embodiments, insert 116 includes an outer annular flange 120 disposed about the periphery thereof. Flange 120 includes first and second opposed surfaces 120*a* and 120*b*. Disposed on a forward surface of insert 116 is a keyed recess, or notch, 124 for ensuring proper relative orientation between insert 116 and a mating connector assembly for mutual coupling. Insert 116 further includes a plurality of spaced bosses 122*a*, 122*b*, 122*c* and 122*d* disposed about the periphery thereof. Each of the bosses 122*a*–122*d* is comprised of the same elastomeric material as insert 116 and is compressible and resilient and thus capable of continuously taking the shape of an inner undulating flange 128 of coupling nut 118 as described below. Each of the bosses 122*a*–122*d* has tapered lateral, facing edges as well as a tapered end portion.

Disposed about insert 116 is a generally cylindrical coupling nut 118. Coupling nut 118 is open at both ends and may have a knurled outer periphery or may include a plurality of spaced ribs 118*b* disposed about the outer periphery thereof as well as threads 118*a* disposed about an inner periphery thereof. These and additional details of coupling nut 118 are shown in the end-on plan views of FIGS. 22 and 24 as well as in the sectional view of the coupling nut shown in FIG. 23 which is taken along site line 23—23 in FIG. 22. Inner undulating flange 128 is disposed at one end of the generally cylindrical coupling nut 118 and includes alternating inwardly directed projections 130 and outwardly directed recesses 132. With coupling nut 118 disposed about insert 116, the inner threads 118*a* of the coupling nut are adapted for engaging and displacing the mating connector assembly toward and about the insert when the coupling nut is rotated in a first direction. The rotation of coupling nut 118 engaging the mating connector assembly causes displacement of the mating connector assembly until it is in tight-fitting engagement with the first surface 120*a* of the insert's outer annular flange 120.

With coupling nut 118 connected to the mating connector assembly, the coupling nut's undulating flange 128 is disposed about and in engagement with the insert's peripheral, spaced bosses 122*a*–122*d*. As coupling nut 118 is rotated in tightening its connection to the mating connector assembly, the projections 130 on the coupling nut's inner undulating flange 128 engage the insert's outer bosses 122*a*–122*d* to provide a tactile indication of tightening of the electrical connector assembly 110. When the electrical connector assembly 110 is fully tightened, the coupling nut's undulating flange 128 engages a washer 136 disposed about insert 116 and in contact with the second surface 120*b* of the insert's outer annular flange 120, while the mating connector assembly engages the opposing, first surface 120*a* of the insert's flange. A plan view of washer 136 is shown in FIG. 25. Compression and deformation of the insert's outer bosses 122*a*–122*d* by the projections 130 on the undulating flange 128 as the coupling nut 118 is tightened provide a secure, locked connection for the electrical connector assembly 110. Coupling nut 118 in this embodiment is preferably comprised of a die cast alloy material.

Referring to FIG. 26, there is shown a plan view of another embodiment of a coupling nut 140 for use in the present invention. Coupling nut 140 includes an inner flange 142 defining a generally circular aperture 144 in the coupling nut. When coupling nut 140 is tightened on the mating connector assembly, the coupling nut's inner flange 142 engages each of the outer bosses 146 as shown in the enlarged partial view of FIG. 27. With the connector insert 148 comprised of a compressible, resilient material, tightening of coupling nut 140 on the mating connector assembly causes the coupling nut's inner flange 142 to compress each of the insert's outer bosses as shown in FIG. 27 for outer boss 146. Coupling nut compression of the connector insert's outer bosses provides this embodiment of the inventive electrical connector assembly with a self-locking feature.

There has thus been shown a vibration resistant electrical coupling adapted for connection to a complementary connector assembly which provides for locked engagement between the male and female connector components as well as a tactile indication of connector tightening by means of an outer, threaded coupling nut. The various embodiments make use of a locking washer disposed between and engaging the coupling nut and an elastomeric insert; a split-washer disposed between and engaging the elastomeric insert and a ratchet surface on the coupling nut; and a plurality of spaced bosses disposed about an outer portion of the insert which are engaged and deformed by an undulating inner surface of the coupling nut. Each of these embodiments provides a locked connection which can be released by reverse rotation of the coupling nut. The inventive electrical coupling further includes an outer sheath disposed about the coupling nut which limits the tightening torque applied to the coupling nut, and allows the coupling nut to be backed-off for disconnection.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A connector assembly for coupling to another mating connector, said connector assembly comprising:

a molded body coupled to an electrical cord;

an elastomeric insert adapted for electrical coupling to the mating connector and integral with said molded body, said insert including a peripheral, annular flange disposed thereabout having first and second opposed surfaces;

a coupling nut disposed about said insert and including internal threads for coupling to the mating connector, said coupling nut further including a plurality of spaced, beveled detents disposed about an inner periphery thereof, wherein when said coupling nut is rotated in a first direction the mating connector is drawn toward said insert until said mating connector engages the first surface of the insert's flange; and a washer disposed intermediate said coupling nut and said insert for engaging and rotating with said coupling nut when said coupling nut is rotated, said washer including a first plurality of spaced, raised, asymmetrical projections on a first surface thereof and a second plurality of spaced, raised projections on a second, opposed surface thereof, wherein said first projections engage the second surface of the insert's flange when the mating connector engages the first surface of the detent's flange and said second projections are disposed within said detents so as to couple said mating connector and said insert in a locked manner.

2. The connector assembly of claim 1 wherein each of said first plurality of asymmetrical projections includes a first lead-in ramp and a second back-off ramp, wherein said first lead-in ramp has a first slope with respect to one of said first plurality of projections for facilitating tight-fitting engagement of said first plurality of projections with the insert's flange.

3. The connector assembly of claim 2 wherein said second back-off ramp has a second slope with respect to one of said first plurality of projections for increasing resistance to removal of said first projections from the insert's flange when said coupling nut is rotated in a second, opposed direction to resist uncoupling.

4. The connector assembly of claim 3 wherein said second slope is greater than said first slope.

5. The connector assembly of claim 4 wherein each of said first plurality of projections includes a distal flat surface for engaging said second surface of the insert's flange.

6. The connector assembly of claim 5 wherein said coupling nut includes an inner, annular flange disposed adjacent an end thereof, and wherein said beveled detents are disposed on said inner, annular flange.

7. The connector assembly of claim 1 wherein said insert is comprised of polyvinyl chloride.

8. The connector assembly of claim 1 wherein said coupling nut is comprised of a die cast metal.

9. The connector assembly of claim 1 wherein said washer is comprised of an acetal resin such as Delrin.

10. A connector assembly for coupling to another mating connector, said connector assembly comprising:

a molded body coupled to an electrical cord;

an elastomeric insert adapted for electrical coupling to the mating connector and integral with said molded body, said insert including a peripheral, annular flange disposed thereabout having first and second opposed annular surfaces;

a coupling nut disposed about said insert and including internal threads for coupling to said mating connector and an inwardly extending annual flange arranged in opposing relation with said second annular surface of said insert; and a vibration-resistant washer rotatable with said coupling nut and including a plurality of spaced, raised, asymmetrical projections on one side thereof, each projection having an inclined lead-in surface and an inclined back-off surface, wherein said projections engage said second surface of said peripheral, annular flange of said insert when said connector assembly is assembled to said mating connector and characterized in that the resistance to turning of said coupling nut presented by said back-off surfaces of said projections in engagement with said peripheral, annular flange of said insert is greater than that presented by said lead-in surfaces, thereby to increase the decoupling torque, said washing further including a plurality of symmetrical teeth on the opposing side thereof for engaging corresponding teeth on the inner surface of said annular flange of said coupling nut in driving engagement when said coupling nut is tightened on said mating connector.

11. The article of claim 10 wherein said washer is composed of an acetal resin.

* * * * *